United States Patent [19]

De Lathauwer et al.

[11] 4,419,291

[45] * Dec. 6, 1983

[54] PROCESS FOR THE DIRECTED INTERESTERIFICATION OF A TRIGLYCERIDE OIL OR OIL MIXTURE AND TRIGLYCERIDE OILS OR OIL MIXTURE THUS INTERESTERIFIED

[75] Inventors: René De Lathauwer, Herent; Martin Van Opstal; Albert J. Dijkstra, both of Izegem, all of Belgium

[73] Assignee: Safinco, Belgium

[ * ] Notice: The portion of the term of this patent subsequent to Aug. 18, 1998 has been disclaimed.

[21] Appl. No.: 258,794

[22] Filed: Apr. 29, 1981

Related U.S. Application Data

[63] Continuation of Ser. No. 74,474, Sep. 11, 1979, Pat. No. 4,284,578.

[30] Foreign Application Priority Data

Sep. 14, 1978 [BE] Belgium ..... 870481

[51] Int. Cl.[3] ..... C11C 3/02

[52] U.S. Cl. ..... 260/410.7; 426/607

[58] Field of Search ..... 260/410.7; 426/607

[56] References Cited

U.S. PATENT DOCUMENTS

| | | | |
|---|---|---|---|
| 2,442,531 | 6/1948 | Eckey | 260/410.7 |
| 2,442,532 | 6/1948 | Eckey | 260/410.7 |
| 2,733,251 | 1/1956 | Hawley | 260/410.7 |
| 2,738,278 | 3/1956 | Holman et al. | 260/410.7 |
| 2,875,067 | 2/1959 | Holman et al. | 260/410.7 |
| 3,748,348 | 7/1973 | Sreenivasan | 260/410.7 |
| 3,855,254 | 12/1974 | Haighton et al. | 260/410.7 |
| 3,859,447 | 1/1975 | Sreenivasan | 260/410.7 |

*Primary Examiner*—John F. Niebling

*Attorney, Agent, or Firm*—Scully, Scott, Murphy & Presser

[57] ABSTRACT

Process for the directed interesterification of a triglyceride oil or oil mixture comprising the addition of a catalyst to the oil or oil mixture at a temperature below 50° C., the activation of the catalyst below this temperature and the use of successive high and low temperatures in several cycles, the activation of the catalyst being combined with a very fast cooling of short or relatively short duration.

10 Claims, 4 Drawing Figures

Figure 1:
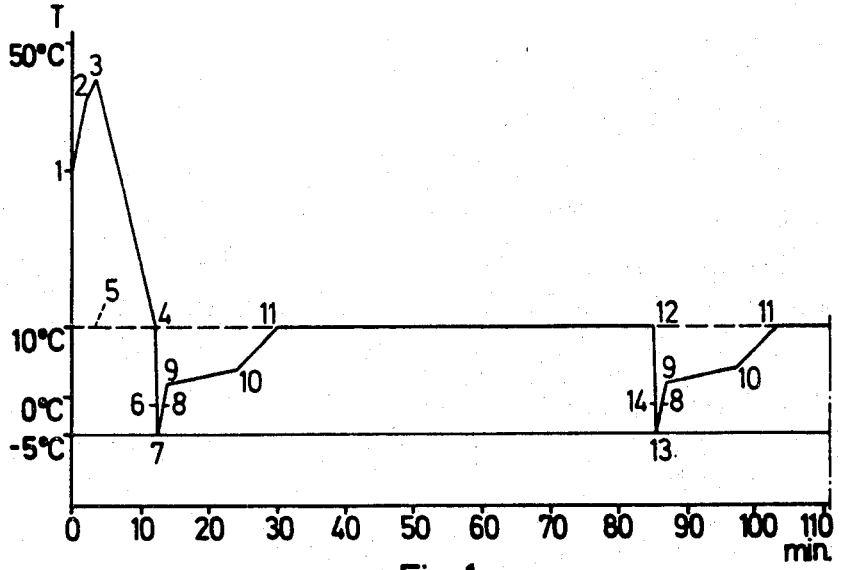

PROCESS FOR THE DIRECTED INTERESTERIFICATION OF A TRIGLYCERIDE OIL OR OIL MIXTURE AND TRIGLYCERIDE OILS OR OIL MIXTURE THUS INTERESTERIFIED

This is a continuation of application Ser. No. 074,474, filed Sept. 11, 1979 U.S. Pat. No. 4,284,578.

The invention relates to a process for the directed interesterification of a triglyceride oil or oil mixture whereby a catalyst that is active at temperatures below 50° C. is added to at least a part of the oil or oil mixture at a temperature below 50° C. and is activated also below this temperature, whereafter the total amount of oil or oil mixture is subjected to two successive cooling stages separated by a heating stage whereby each cooling stage covers the temperature range from a temperature above the cloud point of the oil or oil mixture as found after the activation (the so called reference cloud point) to a few degrees below this cloud point.

The cloud point is generally determined in accordance with the well-known cloud point test of the A.O.C.S. "Official Methods Cc 6-25".

A process of this kind is known from U.S. Pat. No. 2,733,251. According to this known process a sodium/-potassium—alloy is added to triglycerides as lard or cottonseed oil at a temperature below 50° C. as a catalyst active at a low temperature. The activation also takes place below 50° C. However, the period of time between the change of colour of the oil when the temperature rises and the start of the cooling stage is rather long: 2.5 to 12 min and for liquid oils apparently 9 min or more. A possible way of completing the interesterification is indicated whereby after a cooling stage down to a temperature that lies apparently between the original cloud point and the cloud point observed after activation, a heating stage is introduced whereafter a second cooling stage is effected down to the same or a slightly higher temperature.

However, none of the examples given shows more than 2.5 to 3 cyles because there are only three high temperature stages (and thus three opportunities to reach chemical equilibrium) and two low temperature stages around the cloud point attained after activation. The examples showing more than one cycle moreover do not refer to a liquid oil but to lard. If the examples given for lard were to be applied to a liquid oil, the final product would still be liquid at room temperature.

According to this known process, the final cooling stage only is rather short and fast, whereas the second cooling stage takes ten times as long and no indication about the rate of cooling is given. Taking the generally held belief into account that triglycerides need time to crystallize it can be assumed that subsequent cooling stages, if any, were rather slow. In addition, the second heating stage also took much more time so that directed interesterification according to this known process is extremely time-consuming.

The process according to the Netherlands patent No. 145.279 aims at reducing the time required, but despite the fact that a catalyst is used that is reasonably active at a low temperature, this catalyst is activated immediately after its addition. Activation can take place as soon as the temperature has been brought down under 100° C. and usually occurs above 60° C. Such a high activation temperature can be to the detriment of further catalytic activity for interesterification. Therefore the process according to Netherlands patent No. 145.279 is not according to the type mentioned above. Moreover, the time required for the interesterification according to the process of the Netherlands patent is still relatively long.

According to the examples dealing with liquid oil mentioned in the patent, each cooling stage takes between 30 and 90 min and each heating stage between 1 and 4 hours. Moreover, a comparison between examples II and IV reveals that shortening the heating stage from 4 hours to 1 hour has an unfavourable effect upon the solid fat content at room temperature.

The present invention aims at remedying these disadvantages and at providing a process for the directed interesterification of liquid triglyceride oils that is relatively fast and that makes it possible to attain a sufficiently high solid fat content, melting point and cloud point more rapidly than according to processes already known.

For this purpose the oil or oil mixture is first of all cooled down during a preliminary cooling stage from the activation temperature that is held below 50° C. without allowing the temperature to rise above 50° C. to a temperature not higher than a maximum of 42° C. below the final activation temperature at a cooling rate of between 5° C. per second and 1° C. per minute until the chosen upper temperature stage of the cycle is reached. Subsequently, the oil or oil mixture is pumped through a heat exchanger whereby the oil or oil mixture is cooled at a rate of between 5° C. per second and 5° C. per minute and with a mean residence time in the heat exchanger of less than 4 minutes, thus arriving at the lower temperature stage of the cycle that is below the reference cloud point. Subsequently the oil is allowed to warm up until the temperature of this cloud point is again reached. Accordingly, the first cycle as described above, which starts when the upper temperature stage is first reached and ends when the reference cloud point reached for the second time, takes at most 20 min. The first cycle is subsequently continued to a total of at least three successive cycles, viz. with a second and further cycles, which successive cycles comprise a further rise in temperature (that may require an external supply of heat) from the reference cloud point to a few degrees above this point, a variable period during which this temperature is maintained, followed by a rapid decrease in temperature below the reference cloud point and an increase in temperature until the reference cloud point is again reached. The period of time required for each of the second and further cycles does not exceed 120 min. The cooling stages of each of the second and further cycles is again carried out by pumping the oil or oil mixture through a heat exchanger in which the oil or oil mixture is cooled at a rate of between 5° C. per second and 5° C. per minute and with a residence time in the heat exchanger of under 4 minutes.

The use of successive high and low temperatures in several cycles was already a known means of raising the solid fat content in interesterified oil and raising the cloud point and the melting point of these interesterified products. However, the combined activation of the catalyst below 50° C. (which permits the use of for instance potassium/sodium catalyst without causing appreciable degradation of the oil during interesterification) and a very fast cooling of short to relatively short duration is, however, surprising.

In a variant of the process according to the invention, the total duration of the heating stage and the maintenance of the upper temperature is less than 80 minutes.

Naturally, this relatively short duration of the heating stage has a favourable effect on the total duration of the interesterificiation.

In an effective variant of the process according to the invention, the interesterification catalyst is added at a temperature below 42° C. Another effective variant of the invention is characterized by the activation of the interesterification catalyst at the temperature at which it is added.

In an economical variant of the invention a sodium/-potassium alloy is used an interesterificiation catalyst.

A preferred variant of the invention also employs, in addition to the first cycle, between 3 and 7 successive cycles.

The invention also applies to a triglyceride oil or oil mixture interesterified according to the process as described in one of the above variants.

Other particulars and advantages of the invention will become apparent from the description to be given of a process for the directed interesterification of liquid triglyceride oils and of the interesterified oils according to this invention: this description is only given as an illustration and in no way limits the scope of the invention. The numbers refer to the figures in the annex.

FIGS. 1 to 4 represent graphs giving changes in temperature as a function of time for several different variants of the process according to the invention.

The same numbers refer to the same elements in the various graphs.

The process according to the invention is mainly characterized by the addition of an interesterification catalyst which is active below 50° C. to a liquid oil at a temperature below 50° C. and by the activation of this catalyst below 50° C. and the repeated subsequent rapid cooling of the oil in a particular manner below the cloud point found after activation and, of course by the warming up between the cooling stages to the upper cycle temperature.

The oil to be used as a raw material can be a liquid oil or one of a wide variety of mixtures. Sunflower oil, safflower oil, soybean oil, cottonseed oil, corn oil, groundnut oil, grapeseed oil, apple seed oil and other vegetable oils or combinations of these oils can be used. Oils with a high linolic acid content are to be preferred. The oils can, if so desired, be modified by the addition of a fat that may even be liquid, so as to raise the fraction of saturated fatty acids of the reaction mixture. The oils can also be refined according to the customary processes to remove the unsaponifiable fraction which could hinder the process.

The interesterification catalyst to be used is to be active at low temperatures, and at least below 50° C. Preferably, a catalyst that is liquid at such temperatures should be used.

Not only the addition but also the activation itself has to be carried out below 50° C. The activation of the catalyst is carried out preferably between 42° and 45° C., which can be the temperature of the addition. Suitable catalysts are for example sodium/potassium—alloys, other alkalimetal alloys or even pure alkali metals. The catalyst is to be finaly dispersed after addition to the oil, for instance by homogenization.

Water and free fatty acids have to be removed according to customary practice in accordance with the requirements of the catalyst. Preferably, the oil should contain less than 0.01 to 0.02 wt.% water and less than 0.02 to 0.05 wt.% free fatty acids prior to the addition of the catalyst. The catalyst concentration has to be adjusted to each individual situation but will generally amount to 0.05 to 0.5 wt. % of the starting material.

The period of time required for activation will have to be adjusted according to the oil used. When addition to below 42° C., this period of time can be less than 2 minutes.

Immediately after activation, which results in a slight increase in temperature which nevertheless still remains below 50° C., the oil is first of all cooled to an upper temperature stage, as chosen beforehand: this cooling period is the adjustment stage. During subsequent cycles this upper temperature is never exceeded to an appreciable extent. The adjustment stage usually takes a few minutes. It can be reduced to less than one minute, e.g. a few seconds. During the adjustment stage the rate of cooling is between 5° C. per second and 1° C. per minute. Small variations in the most suitable high cycle temperature can occur but generally this temperatue will not be far from 32° to 42° C. below the final temperature after activation. The high cycle temperature is chosen in such a way that the crystals desired survive and do not dissolve. However, undesirable crystals that may have been formed should dissolve.

As soon as the upper cycle temperature has been reached, the first cycle of a series comprising usually 4 to 8 cycles is started. Each cycle comprises a period of time at the upper temperature (which period may vary from one cycle to another), a rapid cooling to below the reference cloud point an a warming up until this reference cloud point has again been reached. However, the final cycle differs completely from subsequent cycles. Firstly, the first cycle commences at the upper cycle temperature, whereas subsequent cycles commence at a temperature equal to the reference cloud point. Secondly, the period of time during which the reaction mixture is hold at the upper temperature may, in the first cycle, be negligible or even zero. In addition, the first cycle may entail at its start an additional rapid cooling from the upper cycle temperature to the reference cloud point and an additional rapid rise in temperature to the upper temperature. With respect to the second cycle it must be mentioned that its residence time at the upper temperature may be so short that its total duration may be below 25 min.

During the first cycle the oil or oil mixture is pumped through a heat exchanger so that the oil is cooled at a rate of 5° C. per minute to 5° C. per second down to a few degrees below the cloud point as observed after activation. The total decrease in temperature is usually between 7° and; 17° C. The mean residence time in the heat exchanger is between 2 seconds and 4 minutes. Usually this residence time is only 2 to 120 seconds or even 2 to 60 seconds. The lowest temperature to which the oil or oil mixture is cooled in this manner during the first cycle is the lower cycle temperature; this temperature is more or less adhered to during subsequent cycles. The lower cycle temperature is chosen in such a way that desirable triglycerides separate as crystals. Naturally this temperature is below the cloud point of the reaction mixture; it has to be sufficiently high to limit the formation of undesirable crystals as much as possible.

The oil or oil mixture may be held at the lower cycle temperature for some time, for instance until 4 minutes have passed; this, however, has be found to yield no better results in most cases. The crystallization resulting from the sudden decrease in temperature causes latent heat of crystallization to be liberated. In addition, further external heat is supplied, as a result of which the temperature rises (either before or during the supply of heat) and the reference cloud point is reached again. This is the end of the first cycle. The total duration of this first cycle-thus from the upper cycle temperature until the reference cloud point is reached again after the cooling stage-is less than 20 minutes and preferably even less than 15 minutes or even less than 1 minute if so desired.

After the first cycle, heating is continued when feeding the second reaction vessel or in this vessel itself. In this manner, the upper cycle temperature is again reached and the reaction mixture is held at this temperature for a period preferably less than 60 minutes. During this and each subsequent heating stage care must be taken to avoid local overheating and to maintain only a small temperature difference between the reaction mixture and the heating medium. Subsequently, the reaction mixture is again cooled at a rate of between 5° C. per minute and 5° C. per second until below the reference cloud point down to the lower cycle temperature mentioned above. As a result of the liberation of latent heat of crystallization and (if necessary) external supply of heat the reference cloud point is again reached, thus terminating the second cycle. The second cycle is usually carried out in a period less than 25 minutes. Further liberation of heat of crystallization and possibly supply of external heat cause the reaction mixture to reach again the upper cycle temperature.

The continuation of the third cycle, the start of which is described above, and of subsequent cycles is completely analogous to the second cycle with the difference that the period of time during which the upper cycle temperature is maintained is generally between 40 and 60 minutes or even somewhat longer.

The solid fat content, melting point and actual cloud point go up with each cycle, but in order to obtain a fat that does not oil out, a sufficient number of cycles has to be carried out. The period of time during which the upper cycle temperature is maintained may differ from cycle to cycle and may depend upon the starting mixture. Also the way in which the temperature is raised from the reference cloud point to the upper cycle temperatue may vary. The combined heating stage and upper temperature stage of the third and subsequent cycles, i.e. from the start of the cycle to the start of the cooling stage, is less than 120 min and for instance between 5 and 120 minutes or preferably less than 80 min, for example between 30 and 80 minutes. Lenghtening this heating stage to 120 min or more for one or more cycles will hardly ever be useful. The total duration of each of the three or more cycles following the first and second cycle is less than 120 minutes. The duration of the second cycle can be the same as those of subsequent cycles. Generally, the shorter cycles are at the start, with the first cycle being the shortest. Care must be taken especially during the first cycle, but if so desired also during the second cycle, to ensure a short upper temperature stage, that is to say the period of time during which the oil is kept at a temperature above the reference close point.

The process can be executed as a batch process or continuously. It goes without saying that the complete operation has to be executed while moisture and air are excluded. Preferably, the cycles are carried out under a nitrogen blanket. The cooling stage can be carried out according to methods already known, for instance with so-called votators or scraped surface heat exchangers; or it can be carried out during the transfer by pump from one reaction vessel to another. In the laboratory the cooling can be achieved by means of a Archimedes' screw rotating inside a jacketed intensely cooled tube. By choosing the rate of rotation of the screw and its design the rate of cooling can be attained. The heating can also be performed according to known methods for example by means of agitation using a scraping agitator in a jacketed, thermostatted reaction vessel. The cooling stage is carried out during this transfer but the heating stage can also occur partially or wholly during this transfer. Even the cooling during the preliminary cooling stage prior to the first cycle can be during transfer. In fact, the entire directed interesterification process can be executed while transferring an oil or oil mixture that has been dried for example and is at a temperature above the activation temperature. During the transfer the temperature is lowered to the activation temperature, the catalyst is added and the preliminary cooling stage and the cycles are performed. Instead, repeated transfer from one reaction vessel to another and back is also possible, whereby during transfer the cooling stage and part of or the entire cooling stage are carried out.

The possibility must be mentioned of cooling even further prior to the first cycle and immediately after the preliminary cooling stage, until below the reference cloud point, whereby as a result of latent heat of crystallization and a possible external supply of heat, the reference cloud point is again reached. This results in a very short first cycle that may even be less than one minute. This process variant may in some instances lead to improved results. Presumably, the rate of cooling determines the way of crystallization during the interesterification. Anyway a high cooling rate leads to a valuable time saving in reaching the final solid fat content of the oil, both with respect to the total cooling time as with respect to the total heating time. This time-saving can in most cases even be increased by the well-known addition of seeding crystals. Seeding crystals to be used can be various triglyceride mixtures or pure triglycerides and even specific crystal forms. The addition can be in one or several stages but preferably during the upper temperature stage of the cycles. If so desired the crystals can be dispersed between their addition and the cooling stage in order to achieve an improved result.

The method according to the invention will now be illustrated by the following examples. The solid fat content determination of the triglyceride mixtures obtained by directed interesterification was determined according to the method described in J.A.O.C.S. 48 page 7 (1971) by A. J. Waighton, L. F. Vermaas and C. den Hollander; the softening point according to A.O.C.S. method Cc 3-25 and the cloud point as mentioned above (A.O.C.S. method Cc 6-25).

EXAMPLE I

A sample of 1.5 kg sunflower oil was refined according to usual methods to a free fatty acid content of 0.03 wt.% and a residual water content of 0.007 wt.%. The fatty acid composition as expressed in weight percent methyl esters was:

| | | | |
|---|---|---|---|
| C 10 | 0.01 | C 18 | 4.61 |
| C 12 | 0.01 | C 18$^{-}$ | 25.25 |
| C 14 | 0.06 | C 18$^{=}$ | 61.51 |
| C 16 | 6.47 | C 20 | 0.39 |
| C 16$^{-}$ | 0.09 | C 18$^{=}$/20$^{-}$ | 0.72 |
| C 17 | 0.01 | C 22 | 0.79 |

-continued

| | | | |
|---|---|---|---|
| C 16= | 0.05 | C 24 | 0.03 |

In a previously dried reaction vessel an amount of 0.4 wt.% of a sodium/potassium-alloy (50/50 by weight) was added to the oil and homogenized to a firm emulsion. The temperature of this reaction mixture is given in FIG. 1, where point 1 indicates the point of the catalyst addition. As a result of a careful supply of heat, the activation temperature is approached. At about 42° C. the reaction mixture changes its colour which is the point in time when activation starts; this has been indicated in FIG. 1 by point 2. The external supply of heat is now terminated but the activation reaction itself causes a small rise in temperature to 45° C. thus reaching point 3 in FIG. 1. The total duration of the addition and activation of the catalyst is about 4 minutes of which the actual time at a temperature above 42° C. is only 2 minutes.

The temperature in the reaction vessel is now reduced to the upper cycle temperature of 10° C. The resulting preliminary cooling stage takes 8 minutes to reach 10° C. corresponding to point 4 in FIG. 1. The upper cycle temperature is indicated by a line having reference 5. The preliminary cooling mentioned above is continued immediately for 14 seconds at a rate of 1° C. per second; this is the start of the first cycle. This cooling stage is achieved by pumping the reaction mixture by means of a Archimedes' screw rotating in a jacketed intensely cooled tube from the first reaction vessel into a second, previously carefully dried reaction vessel filled with nitrogen. The reference cloud point, as defined above, has been indicated in FIG. 1 by point 6. In this particular instance it was at −1.2° C. Non-directed interesterification according to known methods would have led to a cloud point of 40.5° C. using the same sunflower oil refined in the same manner.

The rapid cooling, however, is not stopped at the cloud point but at a temperature of 3.8° C. below this cloud point, thus at −5° C., at which temperature the triglycerides as desired crystallize to a sufficient degree. At the cloud point 6 the change-over from the upper temperature stage to the lower temperature stage takes place. The end of the cooling stage has been indicated by point 7 in FIG. 1. This lowest temperature is the lower cycle temerature. This lower cycle temperature is not maintained but instead heating is commenced immediately during transfer by pumping. Heating is continued whereby again the temperature of the reference cloud point (−1.2° C.) is attained; this terminates the first cycle indicated in FIG. 1 by point 8. The first cycle thus lasted 1 minute for individual fatty particles counting from the upper temperature, past the reference cloud point and including the rise in temperature until the reference cloud point is again reached.

The second cycle starts when the temperature of −1.2° C. is exceeded. During the transfer by pumping, latent heat of crystallization is liberated. In a relatively short period of time i.e. less than 1 minute, the reaction mixture reaches a temperature of 2°–4° C. without external supply of heat. The oil is now at a stage as represented by point 9 in FIG. 1. The temperature of 2°–4° C. in the second reaction vessel is maintained until the oil has been transferred in its entirely to this reaction vessel, which takes about 10 minutes. The transfer end point is indicated by point 10 in FIG. 1. The oil is then heated from about 4° C. to the upper cycle temperature of 10° C. over a period of about 5 minutes. The end of the heating stage is indicated by point 11 in FIG. 1. The oil is kept at this temperature for a period of 55 minutes whereafter the reaction mixture is again cooled very rapidly at the same rate of cooling as during the first cycle, i.e. at 1° C. per second, until the lower cycle temperature as defined above is reached. The drop in temperature is achieved by pumping the oil through a tubular heat exchanger back into the first reaction vessel. The start and end point of this rapid cooling stage have been indicated in FIG. 1 by points 12 and 13 respectively. Subsequently, the oil is again, while still being transferred by pump, permitted to reheat by the liberation of the latent heat of crystallization until again the reference cloud point of −1.2° C. (point 14 in FIG. 1) is reached, at which point the second cycle is terminated and the third cycle commences. The second cycle thus took about 70 minutes altogether and thus exemplifies a long cycle.

The third and subsequent cycles are executed fully analogously to the second cycle. Altogether a total of 5 cycles is executed in addition to the first, short cycle. The total duration of the interesterification does amount to some 6 hours including the preliminary cooling stage of the first cycle.

Immediately after the last transfer, 9 parts of solid carbon dioxide and 9 parts of ice as calculated on the catalyst level are added to the reaction mixture in order to disactivate the catalyst, whereupon the reaction mixture is shaken vigourously at low temperature to ensure the complete decomposition of the catalyst. Other known methods of catalyst decomposition can of course also be used. Soap removal by washing and drying of the product thus obtained are also by known methods. The fatty acid composition of the product is virtually identical to what it was prior to the directed interesterification. The results are given in table A.

For the determination of the above-mentioned reference cloud point of −1.2° C., a sample was subjected to the same decomposition and purification conditions prior to the determination of the cloud point according to the method indicated above.

To make a comparison with example I, the same sunflower oil was interesterified with the same catalyst by cooling the reaction mixture to −5° C. for 30 minutes and by keeping it subsequently at 10° C. for 4 hours and by repeating the above mentioned cycle to a total period of 24 hours.

The solid fat content of the directed interesterified mixture was determined according to the method given in J.S.O.C.S. 48 page 7, 1971 as mentioned before. The cloud point of the randomly interesterified mixture was determined according to the cloud point method of the A.O.C.S. "Official method Cc 6-25" and the softening point was determined according to the A.O.C.S. "Method Cc 3-25".

Figure 2:
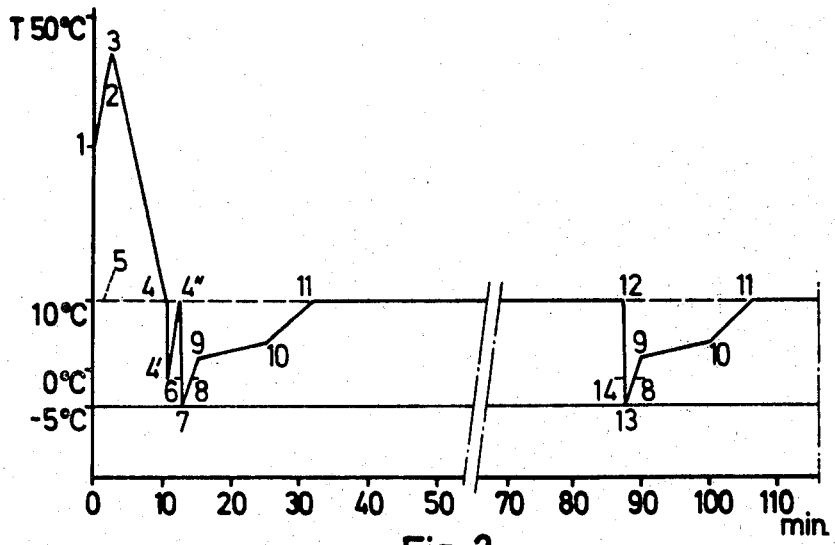

In FIG. 2 the temperature as a function of time has been graphically represented for a variant of the process given in example I. At the start of the first cycle an additional rapid cooling 4-4' is applied more or less down to the reference cloud point followed by a rapid rise in temperature 4'-4'' up to the upper cycle temperature; subsequently a cooling stage according to the process described in example I from the upper cycle temperature to the lower cycle temperature follows (4''-7). Instead of cooling directly from point 4 in FIG. 2 to point 7, the temperature profile includes points 4' and 4''.

EXAMPLE II

Example I is repeated with sunflower oil from which the residual unsaponiable part and part of the diglycerides have been removed, so that only triglycerides take part in the reaction. The time of activation was only one minute.

EXAMPLE III

The process according to example I is repeated using the same sunflower oil but the total duration is increased to 9 hours by raising the number of cycles. The results demonstrate that it is possible to attain a higher solid fat content than achieved up till more in 24 hours within what is still an acceptable length of time. The gain in solid fat content at about room temperature (20° to 25° C.) is evident.

EXAMPLE IV

The process according to example I is repeated once more but now the total duration is increased to 12 hours by raising the number of cycles. As is evident from the results, this even leads to a desirable value for the solid fat content at 30° C.

EXAMPLE V

Example I is repeated using as starting material a mixture of 95 wt.% of a sunflower oil with a high linoleic acid content and 5 wt.% of a randomly esterified mixture of 70 wt.% of the same sunflower oil and 30% of fully hardened sunflower oil; this led to a increase in the saturated fatty acid content by 1.35 wt.% in the sunflower oil. The fatty acid composition of this starting material was:

| | |
|---|---|
| C 12 | 0.02 |
| C 14 | 0.07 |
| C 14⁻ | 0.01 |
| C 16 | 5.99 |
| C 16⁻ | 0.05 |
| C 17 | 0.04 |
| C 16⁼ | 0.01 |
| C 18 | 6.33 |
| C 18⁻ | 14.98 |
| C 18⁼ | 71.48 |
| C 20 | 0.24 |
| C 18⁼/20⁻ | 0.13 |
| C 22 | 0.65 |

The reference cloud point of this reaction mixture was 1.0° C. and the temperature chosen for the cycles were +9.0° C. and −4.8° C.

The activation for the directed interesterification was 30 sec and the preliminary cooling stage lasted 10 minutes. The first cycle lasted 90 sec and the subsequent cycles lasted about 70 minutes. After 7 hours of directed interesterification, the reaction is terminated by mixing the reaction mixture vigourously with water of 10° C. that has been acidified with $H_3PO_4$.

Subsequently a caustic soda solution was added and the oil was washed, dried and steamed.

The product resulting from the directed interesterification had an identical fatty acid composition as the starting material.

The results determined as described in Example I are summarized in Table A. They indicate a fat that, because of its solid fat content, its resistance to oil exudation and its mouthfeel is eminently suitable for the manufacture of a dietary margarine. It exhibits a ratio of polyunsaturated fatty acids to saturated fatty acids of 5.3.

TABLE A

| Temperature (°C.) | Solid fat content (wt. %) | | | | | |
|---|---|---|---|---|---|---|
| | Ex I | Comparison | Ex II | Ex III | Ex IV | Ex V |
| 5 | 7.5 | 7.7 | — | 8.9 | 7.8 | 13.2 |
| 10 | 6.7 | 6.5 | 6.7 | 7.4 | 6.7 | 11.3 |
| 15 | 6.5 | 4.5 | 6.6 | 6.9 | 6.5 | 9.4 |
| 20 | 5.1 | 3.8 | 5.1 | 6.5 | 6.7 | 8.5 |
| 25 | 3.9 | 3.5 | 4.0 | 5.5 | 5.7 | 7.1 |
| 30 | 3.1 | 2.4 | 3.8 | 4.7 | 5.3 | 6.1 |
| 35 | 1.4 | 2.5 | 1.8 | 3.1 | 3.5 | 4.4 |
| 40 | 0.4 | 2.1 | 1.0 | 2.1 | 2.8 | 2.7 |
| 45 | 0.0 | — | 0.7 | 1.5 | 2.0 | 1.2 |
| Melting point (°C.) | 33.8 | — | 34.1 | 34.5 | 34.1 | 32.5 |
| Cloud point (°C.) | 25.5 | 18.5 | 25.8 | 26.5 | 27.0 | 25.6 |

EXAMPLES VI AND VII

The process according to Example I is applied to refined safflower oil with the following fatty acid composition:

| | | | |
|---|---|---|---|
| C 12 | 0.10 | C 18 | 2.78 |
| C 14 | 0.01 | C 18⁻ | 16.75 |
| C 14⁻ | 0.01 | C 18⁼ | 70.99 |
| C 16 | 7.03 | C 20 | 0.45 |
| C 16⁻ | 0.11 | C 18⁼/20⁻ | 1.15 |
| C 17 | 0.04 | C 22 | 0.33 |
| C 16⁼ | 0.02 | C 22⁻ | 0.12 |

The cloud point after activation was −6.5° C. This cloud point was used as reference temperature for the temperature cycles. The upper temperature chosen was +5° C. and the lower temperature was −9° C. After random interesterification the cloud point was −4° C.

During each cycle the cooling from the upper cycle temperature down to the lower cycle temperature was very fast, viz. 2° C. per second and thus took only 7 seconds. The total heating stage of the second and subsequent cycles was 55 minutes. Otherwise the cycles followed the profile as given in FIG. 1. After 6 hours a sample of the reaction mixture was taken (Example VI) and after 12 hours the interesterification was terminated. After 6 hours as well as after 12 hours the fatty acid composition of the refined product was virtually unchanged. The results obtained have been summarized in Table B.

TABLE B

| Temperature °C. | Solid fat content (wt. %) | |
|---|---|---|
| | Ex VI | Ex VII |
| 10 | 4.0 | 5.2 |
| 15 | 4.1 | 5.1 |
| 20 | 2.5 | 3.5 |
| 25 | 2.5 | 4.7 |
| 30 | 3.7 | 3.3 |
| 35 | 0.5 | 1.4 |
| 40 | 1.7 | 0.2 |
| 45 | 0.0 | 0.4 |
| Melting point | 18.0 | 28.5 |
| Cloud point | 15.5 | 20.7 |

EXAMPLE VIII

The process according to Example I is now applied to a refined corn oil with a high iodine value and the following fatty acid composition:

| | | | |
|---|---|---|---|
| C 12 | 0.03 | C 18 | 2.05 |
| C 14 | 0.01 | C 18⁻ | 25.79 |
| C 14⁻ | 0.01 | C 18⁼ | 58.84 |
| C 16 | 10.97 | C 20 | 0.48 |
| C 16⁻ | 0.16 | C 18⁼/20⁻ | 1.40 |
| C 16⁼ | 0.03 | | |
| C 17 | 0.07 | C 22 | 0.15 |

Figure 3:
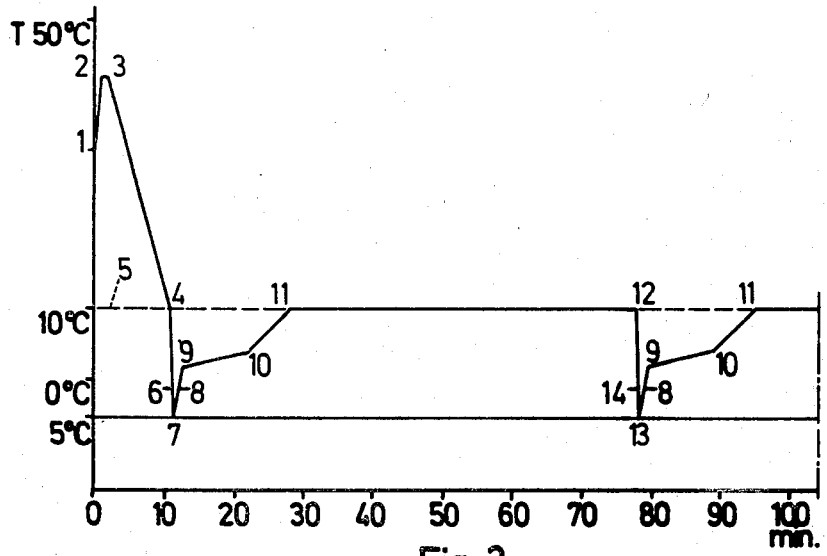
Figure 4:
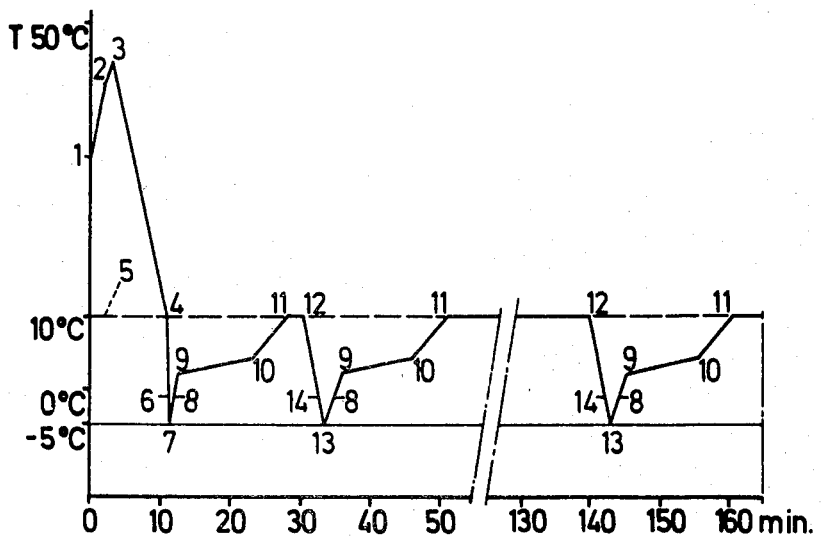

The amount of catalyst was 0.5 wt.% with respect to the oil and the catalyst composition was 60 wt.% potassium and 40 wt.% sodium. The temperature profile of Example VII is represented in FIG. 3. After activation the cloud point was −1.8° C. The upper cycle temperature was chosen at +10° C. and the lower cycle temperature at −5° C. The preliminary cooling period takes 8 minutes. The short and rapid cooling from the upper cycle temperature down to the lower cycle temperature as representated in FIG. 3 by 4-7 or 12-13 lasts 7 seconds at a rate of 2° C. per second. The first cycle commences immediately after the cooling down to the upper cycle temperature and for individual fatty particles lasts about 50 seconds. Transfer by pump from the first to the second reaction vessel takes about 8 minutes. The total heating stage from the cloud point as obtained after activation takes about 70 minutes except for the first cycle. The cloud point after random interesterification as observed in the same corn oil was 0.0° C.

The activation took 30 seconds and the entire interesterification process, comprising 1 short and 5 long cycles took 6 hours. The results obtained have been summarized in Table C given below. After the fat thus obtained had been refined, it was eminently suitable as the sole fatty component in a margarine which after crystallization was characterized by a negligible oil exudation after prolonged storage at 25° C.

Table C also shows the results obtained in a comparative experiment which does not utilize the process according to the present invention. In this experiment the same corn oil was cooled slowly at a rate of 1.5° C. to −5° C. and kept at −5° C. for 20 minutes and than heated to 10° C., at which temperature the oil was held for 1 hour; this cycle was repeated for more than 6 hours.

The process according to Example VII yielded a directed interesterified oil with the same fatty acid composition as prior to its interesterification.

EXAMPLE IX

The process according to Example VIII is repeated with a low iodine value corn oil with the following fatty acid composition:

| | | | |
|---|---|---|---|
| C 12 | 0.05 | C 18⁻ | 35.99 |
| C 14 | 0.01 | C 18⁼ | 46.45 |
| C 16 | 12.84 | C 20 | 0.60 |
| C 16⁻ | 0.19 | C 18⁼/20⁻ | 1.28 |
| C 17 | 0.08 | C 20⁼ isom | 0.08 |
| C 16⁼ | 0.04 | C 22 | 0.11 |
| C 18 | 2.26 | | |

The upper and lower cycle temperatures were 12° C. and −3° C. respectively. The activation period was 1 minute. The cloud point after activation was −0.6° C. and the cloud point after random interesterification of a sample of the same corn oil was +1.3° C. The interesterification was terminated after 6 hours. The results obtained have been summarized in Table C. The fat thus obtained could be used as the sole fatty component in a margarine and did not exude oil after prolonged storage at 25° C.

EXAMPLE X

The process according to Example VIII is repeated using the same corn oil with a high iodine value with the difference that 0.5% seeding crystals were added prior to the first rapid cooling stage; these seeding crystals consist mainly of a mixture of SSU and SUS crystals as obtained during the directed interesterification as described in Example IX. The reaction was also terminated after 6 hours. The results have been summarized in Table C. The final product was eminently suitable as the sole fatty component in margarine and was characterized by lack of oil exudation after 8 weeks storage at 25° C. The increase in saturated fatty acids as a result of the seeding is apparently within the limits of the standard analytical error of the fatty acid analysis.

EXAMPLE XI

The process according to Example VIII is repeated with the same corn oil with a high iodine value but the first rapid cooling stage is executed in 30 seconds, that is to say, at a rate of 0.5° C. per second. The cooling at the second stage is carried out in 2 minutes and the cooling in subsequent cycles in 3 minutes, that is to say, at a cooling rate of 5° C. per minute. The total heating time for the second cycle cas 2.5 minutes and for each of the subsequent cycles 90 minutes. The temperature profile of this process has been set out in FIG. 4.

The final product had a solid fat content that was still acceptable but less favourable than that obtained according to the processes according the previous examples.

TABLE C

| Temperature (°C. | Solid fat content (wt. %) Ex VIII | Comparison | Ex IX | Ex X | Ex XI |
|---|---|---|---|---|---|
| 0 | 13.1 | 8.9 | 13.9 | 14.8 | 11.8 |
| 5 | 12.9 | 6.1 | 12.2 | 13.1 | 9.3 |
| 10 | 10.3 | 3.5 | 9.9 | 11.2 | 7.5 |
| 15 | 8.9 | 2.6 | 8.2 | 9.0 | 5.7 |
| 20 | 7.2 | 1.6 | 6.4 | 8.0 | 5.1 |
| 25 | 6.4 | 1.9 | 4.9 | 5.9 | 4.2 |
| 30 | 4.8 | 2.2 | 4.1 | 5.2 | 3.5 |
| 35 | 3.7 | 1.7 | 2.5 | 4.1 | 2.6 |
| 40 | 2.2 | 1.5 | 0.7 | 1.2 | 1.0 |
| Melting point °C. | 32.5 | <10 | 33.5 | 34.3 | 31.5 |
| Cloud point °C. | 21.5 | 4.8 | 27.5 | 25.5 | 21.5 |

EXAMPLE XII

An amount of 70 liters of the same corn oil as described in Example VIII was subjected to a directed interesterification in reaction vessels of 100 liters capacity exactly as in Example VIII except for the cooling equipment. For the cooling, a scraped heat exchanger of the type commonly used in margarine production was used. The rate of cooling and its duration were chosen as in Example VIII, as were the other elements of the process. A margarine was made in the usual manner from 20 kg of the fat thus obtained 82% fat and 18% water. Its properties are given below:

(1) Dilatation values:

| | |
|---|---|
| 5° C. | 220 ($mm^3$/25 g) |
| 10° C. | 210 |
| 20° C. | 155 |

-continued

| | |
|---|---|
| 25° C. | 120 |
| 30° C. | 100 |
| 35° C. | 45 |

(2) Content of essential fatty acids: 58.87 wt.% in the fat phase. Content of saturated fatty acids: 13.76 wt.% in the fat phase.

(3) Hardness values (as determined according to the method of WAIGHTON, J.A.O.C.S. 36, 345-8 1959):

| | |
|---|---|
| 5° C. | 195 |
| 10° C. | 170 |
| 15° C. | 150 |
| 20° C. | 105 |
| 25° C. | 80 |

The values are similar to the usual hardness values of commercial dietary margarines containing 10% of fully saturated fat or even surpass these values.

EXAMPLES XIII

In reaction vessels of 100 l capacity an amount of 70 l was subjected to a directed interesterification according to the process of Example III using a lower temperature according to Example XII but otherwise the rate of cooling and duration of cooling according to Example III from which the other process elements have also been derived.

A margarine containing 82% fat and 18% water was made in a similar way as in Example XII using 20 kg of this directly interesterified sunflower oil.

The properites are:

(1) Dilatation values at:

| | |
|---|---|
| 5° C. | 185 ($mm^3$/25 g) |
| 10° C. | 172 |
| 20° C. | 105 |
| 25° C. | 87 |
| 30° C. | 65 |
| 35° C. | 28 |

(2) Content of essential fatty acids: 61.56 wt % in the fat phase.

(3) Hardness values (as determined according to the method by Waighton, J.A.O.C.S. 36, 345-8, 1959):

| | |
|---|---|
| 5° C. | 136 |
| 10° C. | 100 |
| 15° C. | 87 |
| 20° C. | 63 |
| 25° C. | 49 |

By subjecting the reaction mixture alternately to heating and cooling, the cloud point, the melting point and the solid fat content are increased, as is known. The problem is, however, that the products mentioned early on have a low content of saturated fatty acids even if they are somewhat enriched; in practice this content is not more than 9.5 to 16%. In addition these saturated fatty acids are, in the case of natural oils, distributed in such a way that they do not favour the formation of any consistency in preparation where this is desirable. In fact, the saturated fatty acids occur mainly in monosaturated triglycerides. Their high linoleic acid content on the other hand makes these products highly suitable for the process according to the invention, given the ultimate aim of obtaining margarines that are rich in linoleic acid.

The activation of the catalyst at low temperature in combination with the rapid and short cooling permit a large saving in time in interesterification despite the fact that progress is shown in the begining in comparison with processes employing higher activation temperature and thus a rapid random interesterification. The factors mentioned permit a considerable decrease in heating time for each cycle with the result that after a total duration of the directed interesterification that is considerably shorter, a final product is obtained that exhibits properties as yet un-equalled and that from liquid oils rich in linoleic acid or liquid oils that have been slightly enriched with solid fat.

The process according to the invention results in an enormous time saving and a decreased demand for frigories. In many instances a better consistency is obtained than is possible with time-consuming processes already known. In most cases the process led to a marked decrease in oil exudation at room temperature which is very difficult to realize if the oils mentioned are used as starting material.

This invention is in no way limited to the methods of execution described above and within the broad terms of the description many modifications can be introduced for example concerning the composition of the oils, their nature, the kind of enrichment fat and the temperatures used. In particular the activation need not necessary take place in the total amount of oil or oil mixture. A part can be activated and admixed with the remainder.

We claim:

1. Process for the directed interesterification of a triglyceride oil or oil mixture which comprises:

(a) adding a low temperature-active interesterification catalyst to the triglyceride oil or oil mixture;

(b) activating the interesterification catalyst at the temperature at which the catalyst is added to the triglyceride oil or oil mixture;

(c) cooling the triglyceride oil or oil mixture containing activated interesterification catalyst to a preselected upper cycle temperature, said temperature being above the reference cloud point temperature of the triglyceride oil or oil mixture;

(d) carrying out a first temperature and time regulated cycle, taking 20 minutes or less wherein, in sequence:

(i) the temperature of the triglyceride oil or oil mixture is rapidly reduced from the upper cycle temperature to the reference cloud point temperature or a preselected lower cycle temperature, said lower cycle temperature being below the reference cloud point temperature; and, (ii) if the temperature of the triglyceride oil or oil mixture is below the reference cloud point temperature, the temperature of the triglyceride mixture is increased to the reference cloud point temperature;

(e) carrying out at least three successive temperature and time regulated cycles with each such cycle taking 120 minutes or less wherein, in sequence:

(i) the temperature of the triglyceride oil or oil mixture is increased from the reference cloud point temperature to the upper cycle temperature;

(ii) the temperature of the triglyceride oil or oil mixture is rapidly reduced from the upper cycle temperature to the lower cycle temperature; and (iii) the temperature of the triglyceride oil or oil mixture is increased from the lower cycle temperature to the reference cloud point temperature.

2. A directed interesterified triglyceride vegetable oil or vegetable oil mixture obtained by the directed interesterification process which comprises:

a. adding a low temperature-active interesterification catalyst to a triglyceride vegetable oil or vegetable oil mixture enriched with a minor amount of a vegetable oil that is relatively rich in saturated fatty acids;

b. activating the interestification catalyst;

c. cooling the triglyceride vegetable oil or vegetable oil mixture containing activated interestification catalyst to a preselected upper cycle temperature, said temperature being above the reference cloud point temperature of the triglyceride vegetable oil or vegetable oil mixture;

d. carrying out a first temperature and time regulated cycle, taking 20 minutes or less wherein, in sequence:

i. the temperature of the triglyceride vegetable oil or vegetable oil mixture is rapidly reduced from the upper cycle temperature to the reference cloud point temperature or a preselected lower cycle temperature, said lower cycle temperature being below the reference cloud point temperature; and, ii. if the temperature of the triglyceride vegetable oil or vegetable oil mixture is below the reference cloud point temperature, the temperature of the triglyceride mixture is increased to the reference cloud point temperature; and, e. carrying out at least three successive temperature and time regulated cycles with each such cycle taking 120 minutes or less wherein, in sequence:

i. the temperature of the triglyceride vegetable oil or vegetable oil mixture is increased from the reference cloud point temperature to the upper cycle temperature;

ii. the temperature of the triglyceride vegetable oil or vegetable oil mixture is rapidly reduced from the upper cycle temperature to the lower cycle temperature; and, iii. the temperature of the triglyceride vegetable oil or vegetable oil mixture in increased from the lower cycle temperature to the reference cloud point temperature, said directed interesterification triglyceride vegetable oil or vegetable oil mixture having a substantially higher solid fat content at a given temperature than that of the same vegetable oil or vegetable oil mixture which has been subjected to directed interesterification under the same conditions but in the absence of added fat rich in saturated fatty acids or randomly interesterified mixture of liquid oil and fully hardened fat.

3. The directed interesterified triglyceride vegetable oil or vegetable oil mixture of claim 2 in which the vegetable fat that is relatively rich in saturated fatty acids is a randomly interesterified mixture or liquid vegetable oil and fully hardened vegetable fat.

4. The directed interesterified triglyceride vegetable oil or vegetable oil mixture of claim 2 in which the vegetable oil mixture following enrichment with vegetable fat that is relatively rich in saturated fatty acids has a total saturated fatty acid content of not more than about 25%.

5. The directed interesterified triglyceride vegetable oil or vegetable oil mixture of claim 2 or claim 3 or claim 4 in which the triglyceride vegetable oil is selected from the group consisting of sunflower oil, safflower oil and corn oil.

6. A margarine prepared from a directed interesterified triglyceride vegetable oil or vegetable oil mixture obtained by the directed interesterification of a vegetable oil or vegetable oil mixture in the presence of a low temperature-active interesterification catalyst wherein prior to activation of said interesterification catalyst, the vegetable oil or vegetable oil mixture is enriched with a minor amount of a vegetable oil that is relatively rich in saturated fatty acids, said directed interesterified triglyceride vegetable oil or vegetable oil mixture having a substantially higher solid fat content at a given temperature than that of the same vegetable oil or vegetable oil mixture which has been subject to directed interesterification under the same conditions but in the absence of added fat rich in saturated fatty acids or randomly interesterified mixture of liquid oil and fully hardened fat.

7. The margarine of claim 6 in which the vegetable fat that is relatively rich is saturated fatty acids is a randomly interesterified mixture of liquid vegetable oil and fully hardened vegetable fat.

8. The margarine of claim 6 in which the vegetable oil or vegetable oil mixture following enrichment with vegetable fat that is relatively rich in saturated fatty acids has a total saturated fatty acid content of not more than about 25%.

9. The margarine of claim 6 in which the directed interesterification comprises the steps:

(a) adding a low temperature-active interesterification catalyst to the triglyceride vegetable oil or vegetable oil mixture;

(b) activating the interesterification catalyst;

(c) cooling the triglyceride vegetable oil or vegetable oil mixture containing activated interesterification catalyst to a preselected upper cycle temperature, said temperature being above the reference cloud point temperature of the triglyceride vegetable oil or vegetable oil mixture;

(d) carrying out a first temperature and time regulated cycle, taking 20 minutes or less wherein, in sequence:

(i) the temperature of the triglyceride vegetable oil or vegetable oil mixture is rapidly reduced from the upper cycle temperature to the reference cloud point temperature or a preselected lower cycle temperature, said lower cycle temperature being below the reference cloud point temperature; and, (ii) if the temperature of the triglyceride vegetable oil or vegetable oil mixture is below the reference cloud point temperature, the temperature of the triglyceride mixture is increased to the reference cloud point temperature;

(e) carrying out at least three successive temperature and time regulated cycles with each such cycle taking 120 minutes or less wherein, in sequence:

(i) the temperature of the triglyceride vegetable oil or vegetable oil mixture is increased from the reference cloud point temperature to the upper cycle temperature;

(ii) the temperature of the triglyceride vegetable oil or vegetable oil mixture is increased from the lower cycle temperature to the reference cloud point temperature.

10. The margarine of claim 6 in which the triglyceride vegetable oil is selected from the group consisting of sunflower oil, safflower oil and corn oil.

* * * * *